US007190917B2

(12) United States Patent
Suzumi et al.

(10) Patent No.: US 7,190,917 B2
(45) Date of Patent: Mar. 13, 2007

(54) IMAGE FORMING APPARATUS WITH DIVIDED OUTPUT OF DC HIGH VOLTAGE SOURCE

(75) Inventors: Masahiko Suzumi, Shizuoka (JP); Akiya Sato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 10/950,427

(22) Filed: Sep. 28, 2004

(65) Prior Publication Data

US 2005/0069337 A1 Mar. 31, 2005

(30) Foreign Application Priority Data

Sep. 30, 2003 (JP) ..... 2003-341483

(51) Int. Cl.
*G03G 15/00* (2006.01)

(52) U.S. Cl. ..... 399/88; 399/50; 399/67; 399/89

(58) Field of Classification Search ..... 399/38, 399/50, 53, 55, 67, 75, 88, 89; 219/216; 363/71

See application file for complete search history.

(56) References Cited

U.S. PATENT DOCUMENTS

| | | | | |
|---|---|---|---|---|
| 4,970,219 | A | 11/1990 | Effland et al. | 514/339 |
| 5,083,168 | A | 1/1992 | Kusaka et al. | 355/285 |
| 5,162,634 | A | 11/1992 | Kusaka et al. | 219/216 |
| 5,262,834 | A | 11/1993 | Kusaka et al. | 355/285 |
| 5,343,019 | A * | 8/1994 | Nashida et al. | 219/216 |
| 5,525,775 | A | 6/1996 | Setoriyama et al. | 219/216 |
| 5,621,630 | A * | 4/1997 | Suzuki et al. | 363/71 |
| 5,862,435 | A | 1/1999 | Suzumi et al. | 399/68 |
| 5,920,757 | A | 7/1999 | Izawa et al. | 399/329 |
| 5,991,555 | A | 11/1999 | Suzumi et al. | 399/18 |
| 6,185,383 | B1 | 2/2001 | Kanari et al. | 399/45 |
| 6,298,213 | B1 | 10/2001 | Miyamoto et al. | 399/320 |
| 6,336,009 | B1 | 1/2002 | Suzumi et al. | 399/67 |
| 6,580,883 | B2 | 6/2003 | Suzumi | 399/69 |
| 6,647,243 | B2 | 11/2003 | Sato et al. | 399/407 |
| 6,701,102 | B2 | 3/2004 | Hasegawa et al. | 399/69 |
| 6,725,011 | B2 | 4/2004 | Sato | 399/405 |
| 6,908,164 | B2 * | 6/2005 | Gilbert et al. | 347/5 |
| 2004/0091277 | A1 | 5/2004 | Miyamoto et al. | 399/50 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |

* cited by examiner

*Primary Examiner*—Hoan Tran
(74) *Attorney, Agent, or Firm*—Fitzpatrick, Cella, Harper & Scinto

(57) ABSTRACT

An output of a DC high voltage source is supplied as a bias to a heat fixing apparatus. An output of the DC high voltage source is divided by resistors, and a divided output is supplied as a DC bias to a charging apparatus. A feedback circuit generates a feedback signal corresponding to a difference between the divided output and a reference voltage, for supply to the DC high voltage source thereby controlling the divided output voltage at a desired value. Such structure allows a supply of a bias voltage to the heat fixing apparatus higher than the bias voltage to the charging apparatus, thereby eliminating defects in the fixing apparatus such as a fixation tailing or an offset phenomenon. Also the charging apparatus can be given an exactly controlled bias voltage, thereby avoiding a halftone density unevenness resulting from an uneven charging.

9 Claims, 6 Drawing Sheets

IMAGE FORMING APPARATUS WITH DIVIDED OUTPUT OF DC HIGH VOLTAGE SOURCE

BACKGROUND OF THE INVENTION

1. Field of the Invention

The present invention relates to an image forming apparatus utilizing an electrophotographic process or an electrostatic recording process, for example a printer such as a laser beam printer or an LED printer, or a digital copying apparatus, and more particularly to an improvement in an image quality at a fixation step thereof.

2. Related Background Art

In a prior image forming apparatus utilizing an electrophotographic process such as a laser beam printer, in case of receiving a print command, an encoded character and image information from an external information processing apparatus such as a computer and converting the code information into image information in a formatter or the like, an image having density information such as a photograph is processed by a known image processing such as a dither matrix process or an error diffusion process and binarization thereby converted into binary image information.

In the following, a prior electrophotographic engine will be explained with reference to FIG. 8.

The electrophotographic engine is provided, around a photosensitive drum (photosensitive member) 201 and along a rotating direction thereof, with a primary charger 202 for charging the photosensitive drum 202, an exposure means 203 for exposing the photosensitive drum 201 thereby forming an electrostatic latent image, a developing apparatus 204 for depositing a toner (developer) onto the electrostatic latent image thereby forming a toner image, a transfer roller (transfer apparatus) 205 for transferring the toner image on the photosensitive drum 201 onto a recording material P, and a cleaning apparatus 207 for eliminating the residual toner. The recording material P for receiving the transfer of the toner image is fed and conveyed from an unillustrated sheet cassette, and is supplied to the photosensitive drum 201. The recording material P supplied to the photosensitive drum 201 receives the transfer of the toner image by the transfer roller 205, then conveyed to a heat fixing apparatus 206 and, after a fixation of the toner image therein, is discharged to the exterior of the apparatus.

As the heat fixing apparatus 206, there is commonly employed an apparatus of heat roller type or an apparatus of film heating type. In particular, there is proposed a method of not supplying an electric power to the heat fixing apparatus in a standby state thereby minimizing the electric power consumption, more specifically a heat fixing method by a film heating method in which a film for fixing the toner image on the recording material is made present between a heater and a pressure roller. For such method, reference is to be made to following patent references 1 to 4:

Patent reference 1: Japanese Patent Application Laid-open No. S63-313182;

Patent reference 2: Japanese Patent Application Laid-open No. H02-157878;

Patent reference 3: Japanese Patent Application Laid-open No. H04-44075; and

Patent reference 4: Japanese Patent Application Laid-open No. H04-204980.

FIG. 9 schematically shows a configuration of a heat fixing apparatus such film heating method. Referring to FIG. 9, there are provided a heating member (hereinafter referred to as heater) 211 fixed to a stay holder (support member) 212, and an elastic pressure roller 210 pressed to the heater 211 across a heat resistant thin film (hereinafter referred to as fixing film) 213 to form a nip portion (fixing nip portion) N of a predetermined nip width. The heater 211 is heated and controlled at a predetermined temperature by a current supply. The fixing film 213 is a cylindrical or endless web-shaped member or a rolled web-shaped member, conveyed in a direction of an arrow a at the fixing nip N in contact with and sliding on the heater 211, by a rotary power of unillustrated drive means or the pressure roller 220.

In a state where the heater 211 is heated and controlled at a predetermined temperature and the fixing film 213 is moved in the arrowed direction, when the recording material P, bearing an unfixed toner image t and constituting a material to be heated, is introduced between the fixing film 213 and the pressure roller 220 in the fixing nip N, the recording material P is in close contact with the surface of the fixing film 213 and is conveyed therewith through the fixing nip N. In such fixing nip N, the recording material P and the toner image t are heated by the heater 211 through the fixing film 213 whereby the toner image t is heat fixed onto the recording material P. A portion of the recording material after passing the fixing nip N is peeled off from the surface of the fixing film 213 and conveyed.

The heater 211 serving as the heating member is generally constituted of a ceramic heater. For example, it is prepared by forming, on a surface (opposed to the fixing film 213) of a ceramic substrate 211*a* of an electrical insulating property, a high thermal conductivity and a low heat capacity such as alumina, a heat generating resistance layer 211*b* such as of silver palladium (Ag/Pd) or $Ta_2N$ for example by screen printing along a longitudinal direction the substrate (perpendicular to the plane of the drawing), and covering the surface of such heat generating resistance layer with a thin glass protective layer 211*c*. In such ceramic heater 211, the heat generating resistance layer 211*b* generates heat by a current supply thereto, whereby the entire heater including the ceramic substrate 211*a* and the glass protective layer 211*c* shows a rapid temperature elevation. Such temperature elevation of the heater 211 is detected by a temperature sensor 214 provided behind the heater and fed back to an unillustrated power supply controller. The power supply controller controls the power supply to the heat generating resistance layer 211*b* in such a manner that the heater temperature detected by the temperature sensor 214 is maintained at a predetermined substantially constant temperature (fixing temperature). Thus the heater 211 is heated and controlled at the predetermined fixing temperature.

The fixing film 213 is made as thin as 20 to 70 μm in order to efficiently transmit the heat of the heater 211 to the recording material P, which is a member to be heated, at the fixing nip N. The fixing film 213 has a three-layered structure of a base film layer, a primer layer and a releasing layer, in which the base film layer is at the side of the heater and the releasing layer is at the side of the pressure roller. The base film layer is formed by polyimide, polyamidimide or PEEK, having a higher insulting property than in the protective glass layer 211*c* of the heater 211, and being highly heat resistant and having a high elasticity. Also the base film layer maintains the mechanical strength such as tensile strength of the entire fixing film 213. The primer layer is formed by a thin layer of about 2 to 6 μm. The releasing layer is provided for preventing toner offsetting to the fixing film 213, and is formed by coating a fluorinated resin such as PFA, PTFE or FEP in a thickness of about 10 μm.

A stay holder 212 is formed for example of a heat resistant plastic member, and supports the heater 211 and also serves as a conveying guide for the fixing film 213.

In a heat fixing apparatus of the film heating type utilizing such thin fixing film 213, because of a high rigidity of the ceramic heater 211 serving as the heating member, the pressure roller 220 having an elastic layer 222 becomes flat along the flat lower surface of the heater 211 to which the roller is pressed, thereby forming a fixing nip N of a predetermined width and the heating is achieved only in the fixing nip N to attain a quick-start heat fixing.

The above-described prior image forming apparatus is known to cause various drawbacks in the image quality at the image fixation.

For example, there are known an offset phenomenon in which, at the heat fixing of an unfixed toner image on the recording material, a part of the toner is not fixed but is deposited on the fixing film and is transferred to the recording material in a next turn of the fixing film, and a fixation tailing phenomenon in which an unfixed toner image is scattered, by vapor ejected from the recording material, in a direction opposite to the conveying direction of the recording material.

As it is known that these phenomena can be alleviated by applying a bias voltage of a polarity same as that of the toner to the fixing roller or the fixing film thereby forming an electric field, in the fixing nip, in a direction of pressing the toner toward the recording material, there is adopted a structure of applying a bias voltage to the fixing roller or the fixing film by high-voltage output means. Also as the high-voltage output means for applying the bias voltage to the fixing roller or the fixing film, a high voltage source used in image forming steps such as charging or development is often utilized, thereby achieving a cost reduction and a compactization of the apparatus.

However, a recent higher process speed in the image forming apparatus tends to aggravate the fixation tailing smears (bleeding) and the offsetting, thus requiring a higher bias voltage as a fixing bias. However, in case the fixing bias voltage is supplied from the high voltage source used for other image forming steps such as charging or development, the fixing bias voltage is determined by an output voltage of such high voltage source so that an even higher bias voltage is not available. More specifically, a charging DC bias voltage and a developing DC bias voltage are determined by certain conditions such as an image density, a line width and a fog level, and the charging DC bias voltage is generally selected at −600 to −700 V while the developing DC bias voltage is generally selected at −400 to −500 V, so that the fixing bias voltage of a larger value cannot be utilized.

In order to avoid such drawback, there can be conceived a method of independently providing a high voltage source for the fixing bias or a method of providing a power source capable of outputting a voltage necessary for the fixing bias and dividing such output voltage for example by voltage-dividing resistors to necessary values for the charging bias or the developing bias, but the former method is associated with drawbacks of an increased dimension and an increased cost of the apparatus, while the latter method has a drawback that the voltage drop by the voltage-dividing resistors varies depending on a load to generate an aberration in the bias voltage, thereby resulting in an uneven density in a halftone image such as a graphic image.

SUMMARY OF THE INVENTION

The present invention has been made in consideration of such situation and is to provide an image forming apparatus capable of providing a satisfactory image without image defects such as an offsetting or a fixation tailing caused by the fixing apparatus and without an unevenness in the halftone density resulting from an uneven charging.

In order to attain the aforementioned object, the image forming apparatus of the present invention has one of following structures (1) to (6):

(1) An image forming apparatus for exposing a photosensitive member charged uniformly by a charging apparatus to form an electrostatic latent image, developing the electrostatic latent image with a developing apparatus, transferring the developed image onto a recording material, and heat fixing the image on the recording material by a heat fixing apparatus, the image forming apparatus including:

a DC high voltage source serving as a bias source for the heat fixing apparatus;

a voltage divider for dividing an output of the DC high voltage source; and a feedback circuit for feeding a divided output of the voltage divider back to the DC high voltage source thereby executing a feedback control in such a manner that the divided output becomes a desired value;

wherein the divided output is used as a bias source for another apparatus in the image forming apparatus.

(2) An image forming apparatus described in (1), in which the another apparatus is the charging apparatus.

(3) An image forming apparatus described in (1), in which the another apparatus is the developing apparatus.

(4) An image forming apparatus for forming, by a gaseous phase discharge, an electrostatic latent image on a dielectric member, developing the electrostatic latent image with a developing apparatus, transferring the developed image onto a recording material, and heat fixing the image on the recording material by a heat fixing apparatus, the image forming apparatus including:

a DC high voltage source serving as a bias source for the heat fixing apparatus;

a voltage divider for dividing an output of the DC high voltage source; and a feedback circuit for feeding a divided output of the voltage divider back to the DC high voltage source thereby executing a feedback control in such a manner that the divided output becomes a desired value;

wherein the divided output is used as a bias source for the developing apparatus.

(5) An image forming apparatus described in any one (1) to (4), in which the heat fixing apparatus includes a fixing film.

(6) An image forming apparatus provided with an exposure apparatus for exposing a photosensitive member charged uniformly by a charging apparatus to form an electrostatic latent image, a developing apparatus for developing the electrostatic latent image, and a heat fixing apparatus for heat fixing an image on a recording material, the image forming apparatus including:

a power source apparatus for supplying the charging apparatus with a charging bias and capable of generating a voltage larger than a voltage required for the charging bias;

a voltage divider for dividing an output of the power source apparatus; and a feedback circuit for feeding a divided output of the voltage divider back to the power source apparatus thereby executing a feedback control in such a manner that the divided output becomes a desired voltage;

wherein the divided output is supplied to the charging apparatus and the output of the power source apparatus is supplied to the heat fixing apparatus.

The present invention allows to obtain a satisfactory image without image defects such as an offsetting or a fixation tailing and without an. unevenness in the halftone density, and can achieve a compact dimension and a reduced cost in the apparatus.

DETAILED DESCRIPTION OF THE PREFERRED EMBODIMENTS

In the following, the present invention will be clarified in detail by preferred embodiments thereof. In the following, there will be explained an image forming apparatus of an electrophotographic process, but the present invention is not limited to such electrophotographic process but is likewise applicable to an image forming apparatus of an electrostatographic process. More specifically, there is known an image forming apparatus of an electrostatographic process which forms, by a gaseous phase discharge, an electrostatic latent image on a dielectric member, develops the electrostatic latent image with a developing apparatus, transfers the developed image onto a recording material, and heat fixes the image on the recording material by a heat fixing apparatus, and the present invention is likewise applicable to the process after the formation of the electrostatic latent image as such process is similar to that in the electrophotographic process.

Figure 1:
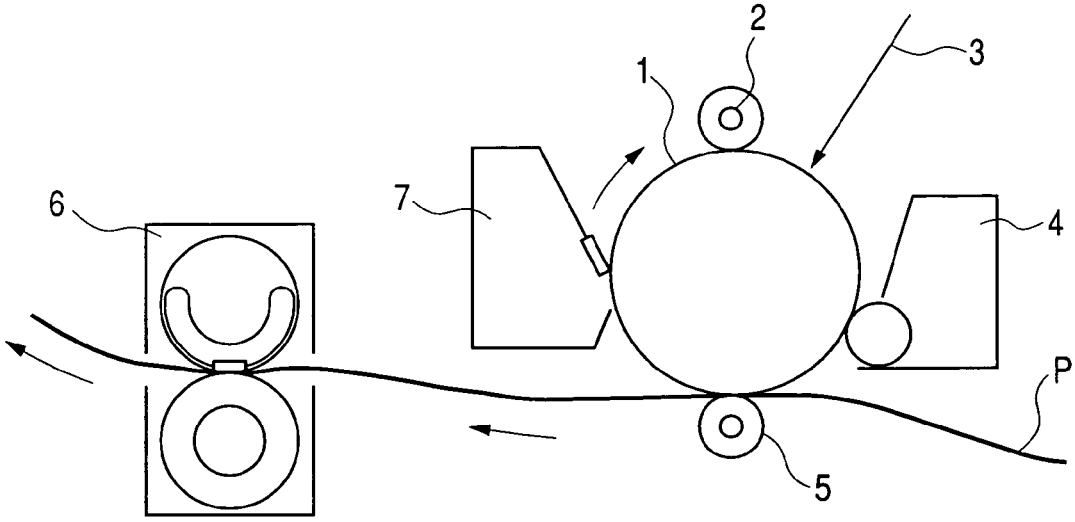
FIG. 1 is a view showing the principal configuration of an embodiment 1.

FIG. 1 is a view showing the principal configuration of an "image forming apparatus" constituting an embodiment. Referring to FIG. 1, a photosensitive drum (photosensitive member) 1 is provided with a photosensitive material such as OPC, amorphous Se, or amorphous Si on a cylindrical substrate such as of aluminum or nickel. The photosensitive drum 1 is rotated in a direction indicated by an arrow, and its surface is uniformly charged by a charging roller 2 serving as a charging apparatus. Then it is subjected to a scanned exposure by a laser beam 3, on/off controlled according to image information, to form an electrostatic latent image. The electrostatic latent image is developed and visualized by a developing apparatus 4. For the development, there can be employed a jumping development, a two-component development, a feed development or the like, and there is often employed a combination of an imagewise exposure and a reversal development.

The visualized toner image is transferred, by a transfer roller 5 serving as a transfer apparatus, from the photosensitive drum 1 onto a recording material P conveyed at a predetermined timing. In this operation, the recording material P is conveyed by pinching between the photosensitive drum 1 and the transfer roller 5 under a predetermined pressure. The recording material P bearing the transferred toner image is conveyed to a heat fixing apparatus 6 and fixed therein as a permanent image. On the other hand, a residual toner, remaining on the photosensitive drum 1 after the transfer, is removed from the surface of the photosensitive drum 1 by a cleaning apparatus 7.

Figure 2:
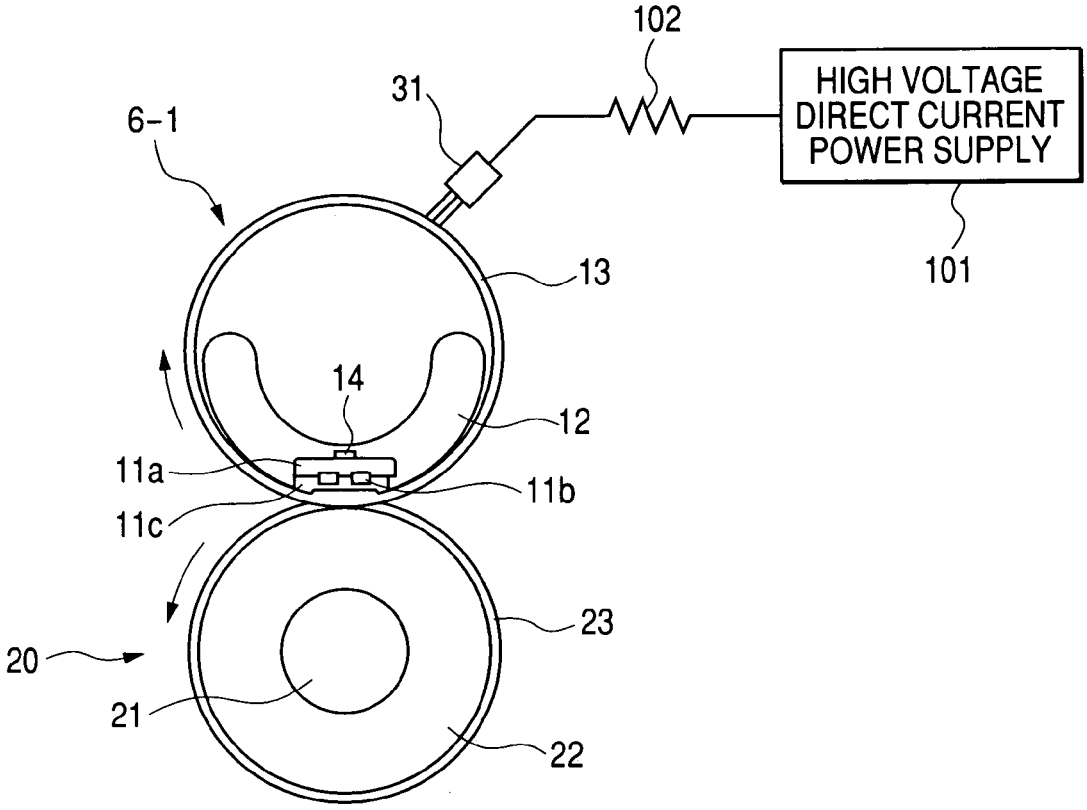
FIG. 2 is a cross-sectional view showing the configuration of a heat fixing apparatus.
Figure 3A:
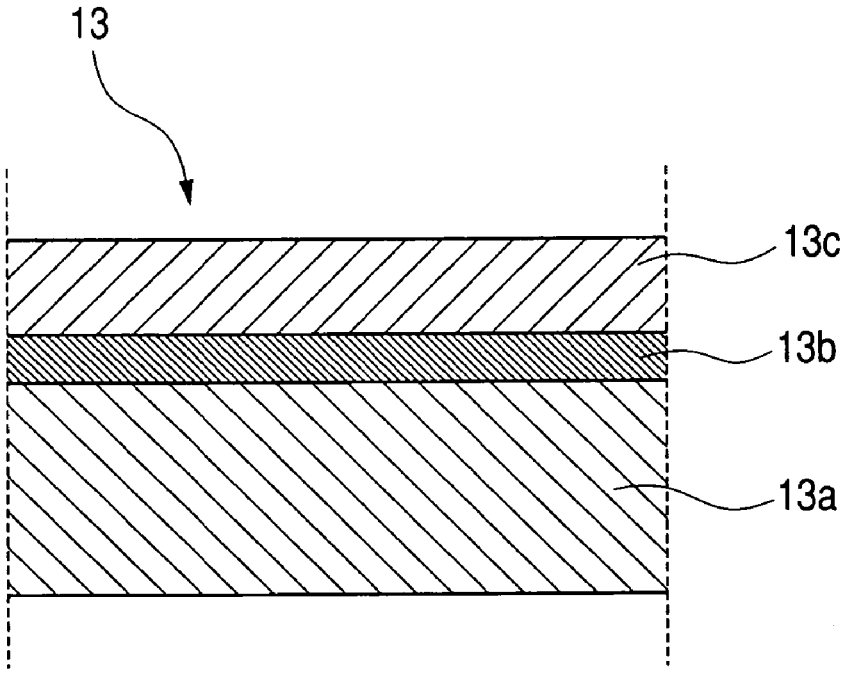
FIGS. 3A and 3B are views showing a layered structure of a fixing film and a method for applying a bias voltage.

FIG. 2 shows the configuration of the heat fixing apparatus 6 employed in the present embodiment. Referring to FIG. 2, a fixing member 6-1 is constituted of following members. A fixing film 13 of a low heat capacity is a composite film which is formed, as shown in FIG. 3A, by coating a releasing layer 13*c* formed by mixing a conductive material such as carbon in PFA, PTFE, FEP or the like, on a heat resistant resinous film 13*a* of a low heat capacity such as of polyimide, polyamidimide, PEEK, PES, PPS, PFA, PTFE or FEP, across a conductive primer layer 13*b*. In order to enable a quick starting, the fixing film 13 preferably has a thickness of 100 μm or less, but a thickness of 20 μm or more is required for securing a sufficient strength and a durability for constituting a heat fixing apparatus of a long service life. Therefore, an optimum thickness of the fixing film 13 is 20 to 100 μm.

Figure 3B:
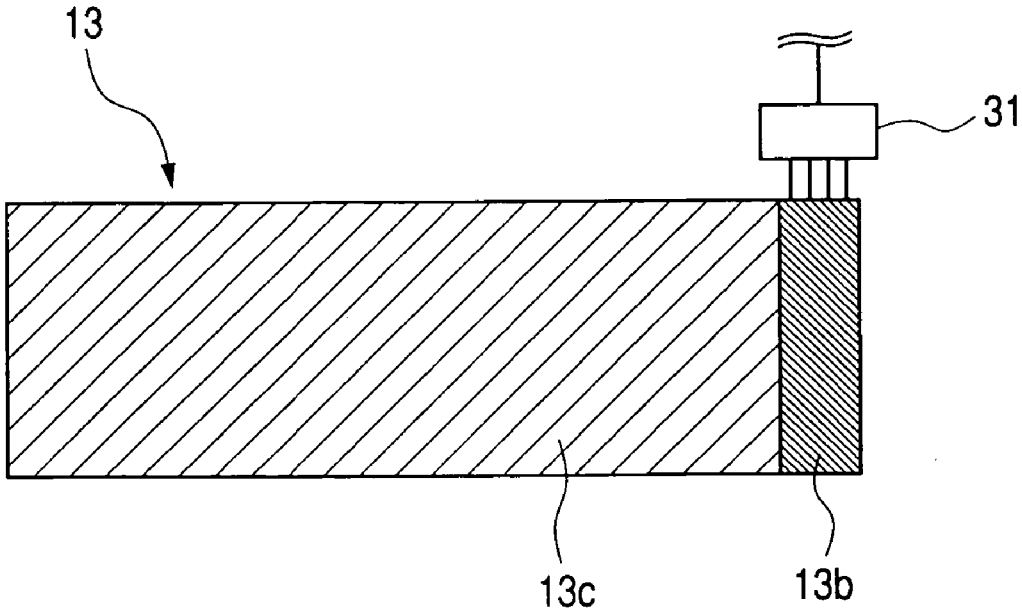

For preventing fixation tailing smears and offset phenomenon, a fixing bias voltage is applied to the fixing film 13, and such fixing bias voltage is applied, as shown in FIG. 3B, by exposing the conductive primer layer 13*b* at an end of the surface of the fixing film, contacting it with current feeding means 31 such as a conductive brush and connecting the current feeding means 31 with a high voltage source 101 across a safety resistor 102.

In addition to the foregoing, the fixing film 13 may be a metal sleeve constituted of a thin metal pipe such as of stainless steel on which the aforementioned releasing layer is coated across a primer layer. In such case, the metal pipe is exposed on a part of the surface of the metal sleeve, for the purpose of grounding or bias voltage application of the fixing film.

A heater 11 provided inside the fixing film 13 is constituted, on an $Al_2O_3$ or AlN substrate or a high thermal conductivity, by forming a heat generating resistance layer 11*b* such as of silver-palladium and forming a thin glass protective layer 11*c* thereon. Such heater 13 is contacted, at the surface thereof bearing the heat generating resistance layer 11*b* or a surface opposite thereto, with the fixing film 13 thereby heating a nip for fusing and fixing a toner image on a recording material.

A heat insulating stay holder 12, for supporting the heater 11 and avoiding heat dissipation to a direction opposite to the nip, is formed for example by a liquid crystal polymer, a phenolic resin, PPS or PEEK, and the fixing film 13 is loosely fitted therearound and rendered rotatable in a direction indicated by an arrow. Since the fixing film 13 rotates in sliding contact with the internal heater 11 and the heat insulating stay holder 12, it is necessary to reduce the friction resistance between the fixing film 13 to the heater 11 and the heat insulating stay holder 12. For this reason, a small amount of a lubricant such as heat resistant grease is provided on the surface of the heater 11 and the heat insulating stay holder 12. Thus the fixing film 13 can rotate smoothly.

A pressure member 20 is provided with an elastic layer 22 formed by foaming heat resistant rubber such as silicone rubber or fluorinated rubber, and a releasing layer such as of PFA, PTFE or FEP may also be provided thereon. In order to suppress charging of the surface of the insulating releasing layer, it is preferred to render the elastic layer 22 by dispersing a conductive material such as carbon black and to ground the metal core or to maintain it at a polarity opposite to that of the toner for example by a diode. The pressure member 20 is sufficiently pressed, at both longitudinal ends by unillustrated pressurizing means, toward the fixing member 6-1 in order to form a nip portion necessary for heat fixation, and is rotated, by unillustrated rotary drive at both longitudinal ends, in a direction indicated by an arrow through the metal core 21. Thus the fixing film is driven, in a direction indicated by an arrow, around the stay holder 12. Otherwise the fixing film 13 is rotated by a rotation of an unillustrated drive roller, which is provided inside the fixing film 13.

The image forming apparatus of the present embodiment has a process speed of 201 mm/s and a throughput of 35 prints per minute (letter size).

The present embodiment explains a case where a fixing bias source and a DC charging bias source are used in common.

Figure 4:
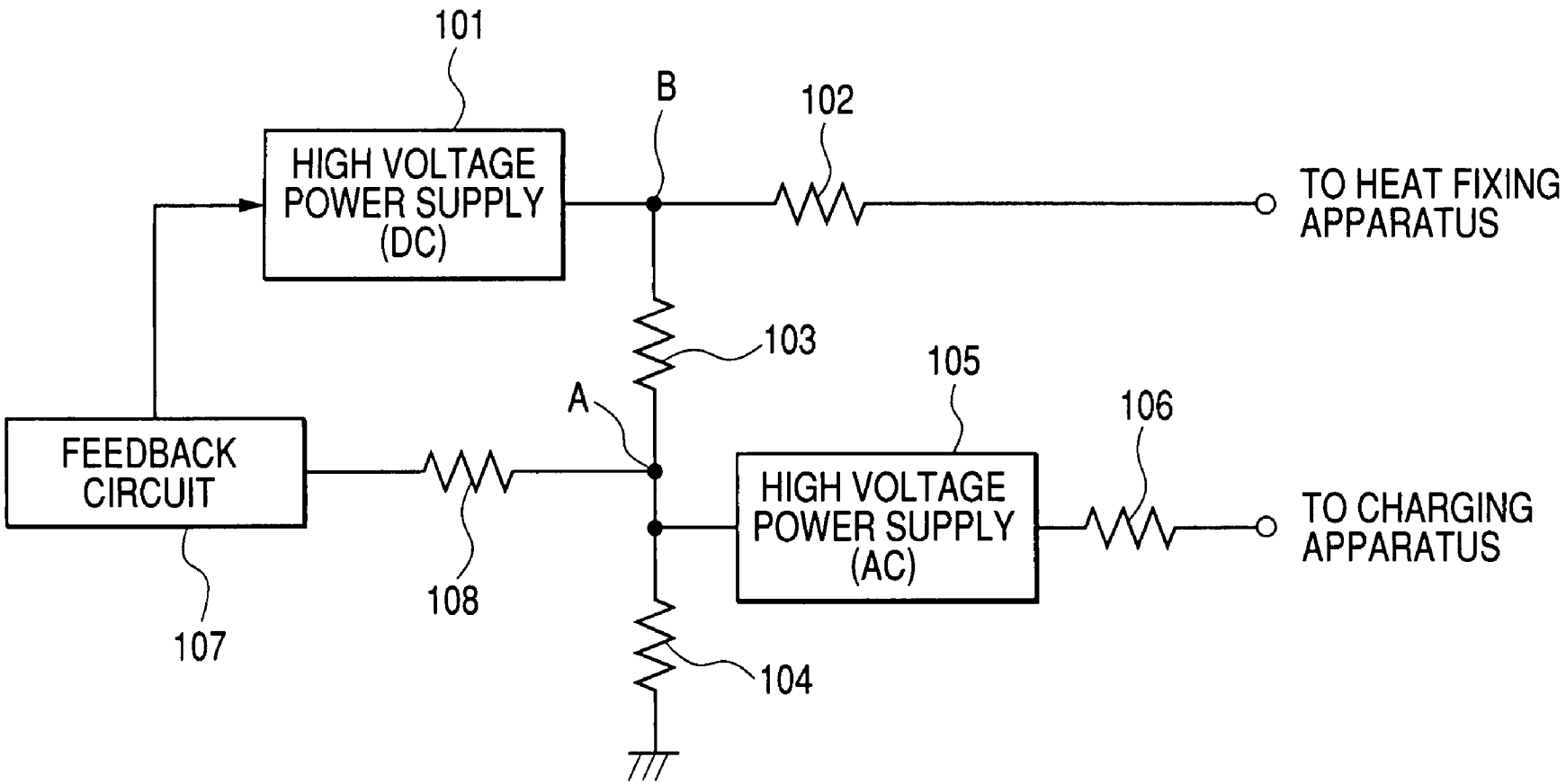
FIG. 4 is a circuit diagram showing a basic structure of a fixing bias and DC charging bias circuit.

FIG. 4 shows a basic structure of a fixing bias and charging bias circuit.

A DC high voltage source 101 is connected through a safety resistor 102 to the heat fixing apparatus 6, thereby supplying thereto a bias voltage (−800 V in the present embodiment) required for preventing fixation tailing and offset. Also the output of the DC high voltage source 101 is divided by voltage-dividing resistors (voltage divider) 103, 104 to a bias voltage which corresponds to a DC charging bias voltage (−605 V in the present embodiment) and which is superposed with an output from an AC high voltage source 105 and supplied as a bias to the charging apparatus through a safety resistor 106. The voltage-dividing resistors have resistances in the order of several megaohms.

The DC high voltage source 101 is feedback controlled by a feedback circuit 107 in order to avoid a fluctuation in the DC charging bias voltage caused by a load fluctuation in the drum or the charging roller (so as to maintain a constant voltage at a point A).

Figure 5:
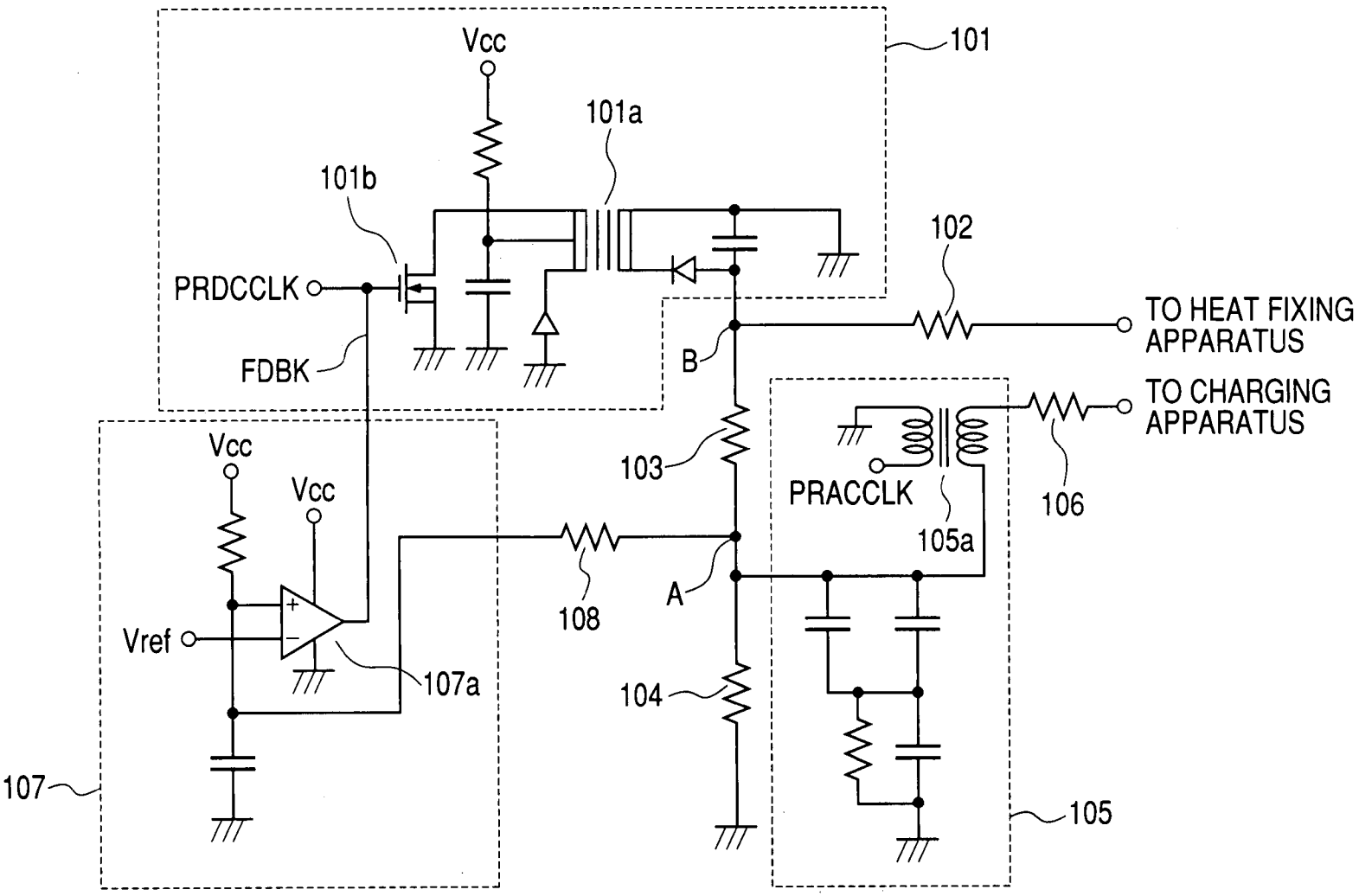
FIG. 5 is a circuit diagram showing a fixing bias and charging bias circuit.

An example of the fixing bias and charging bias circuit will be explained with reference to FIG. 5.

A DC high voltage source 101 is constituted of a DC high voltage transformere 101*a* and a transformer driver 101*b*, and the DC high voltage transformere 101*a* generates a predetermined DC high bias voltage in response to a transformer drive signal (PRDCCLK) and a feedback signal (FDBK) from a feedback circuit 107.

The feedback circuit 107 is constituted of an operational amplifier 107*a* and a reference signal (Vref), and feeds a signal corresponding to a difference of the DC charging bias voltage and the reference signal (Vref) as a feedback signal (FDBK) back to the DC high voltage source 101.

An AC high voltage source 105 is constituted of an AC high voltage transformer 105*a*, and drives the AC high voltage transformer 105*a* by a drive signal (PRACCLK) to generate an AC high voltage bias. In the present embodiment, the AC high voltage source 105 does not have a feedback control, but it is also possible to execute a feedback control such as a constant current control.

In the following there will be explained a relationship of the fixing bias voltage to the fixation tailing and offset phenomenon.

Figure 6:
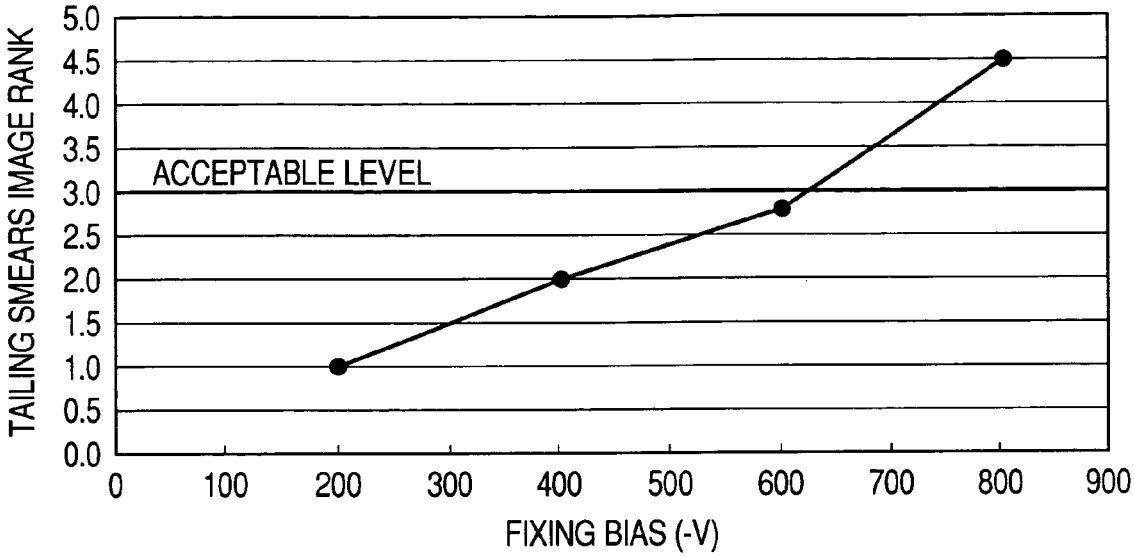
FIG. 6 is a chart showing a relationship between a fixation tailing smears and a fixing bias voltage.
Figure 7:
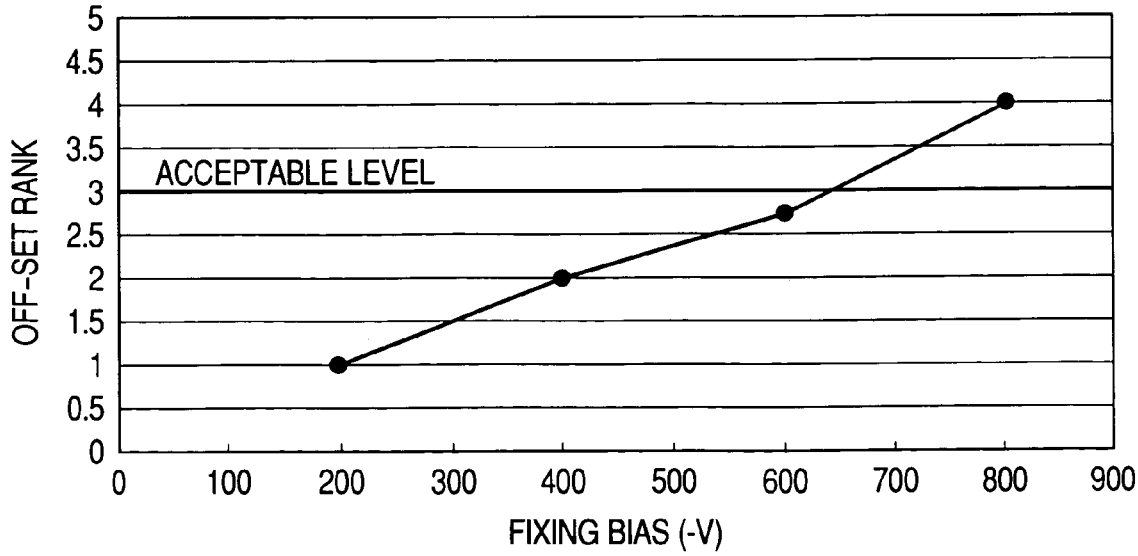
FIG. 7 is a chart showing a relationship between an offsetting and a fixing bias voltage.
Figure 8:
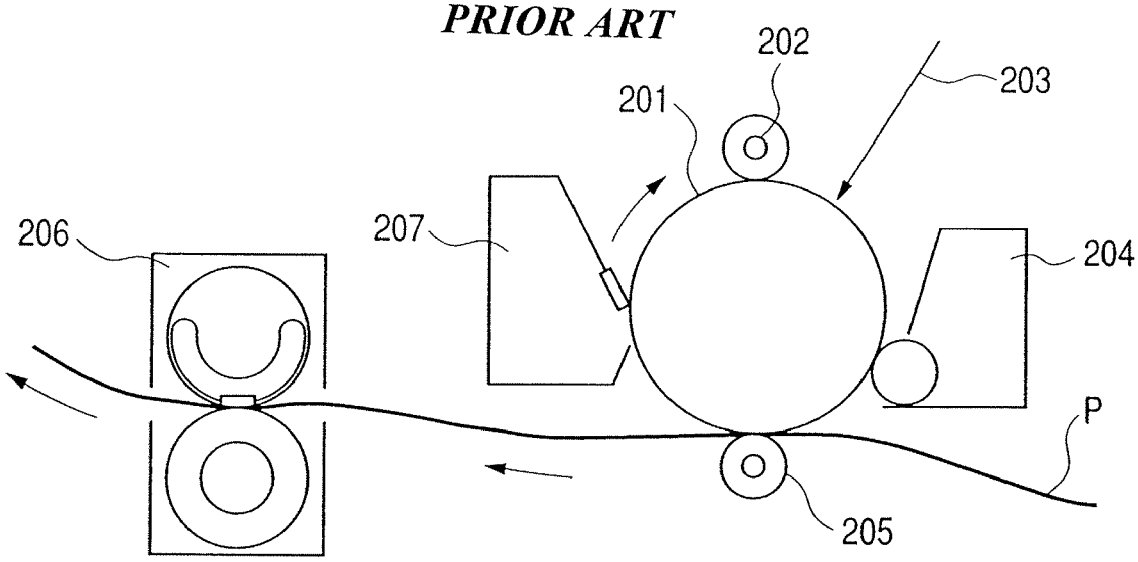
FIG. 8 PRIOR ART
FIG. 8 is a view showing the principal configuration of a prior structure.
Figure 9:
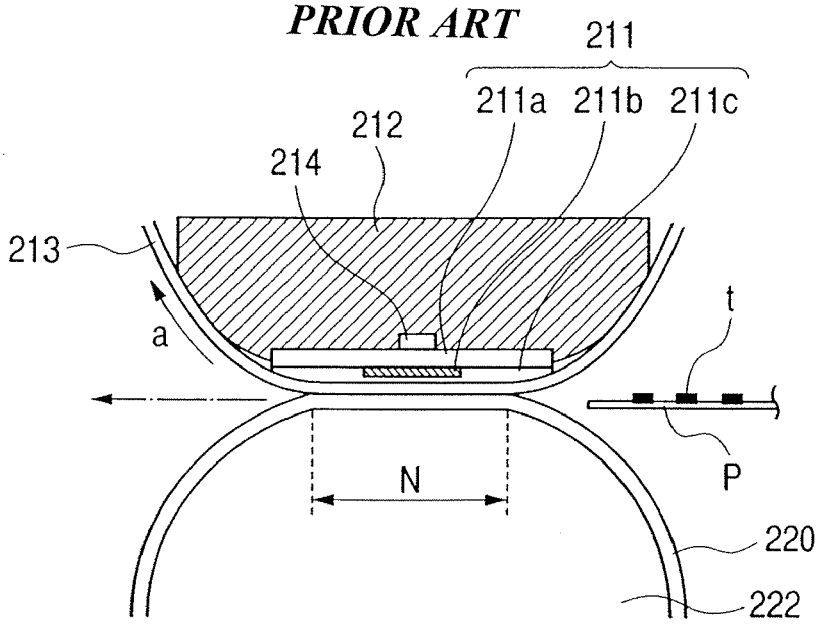
FIG. 9 PRIOR ART
FIG. 9 is a cross-sectional view showing the principal configuration of a heat fixing apparatus.

FIGS. 6 and 7 respectively show a relationship between the fixing bias voltage and the fixation tailing and a relationship between the fixing bias voltage and the offset phenomenon, both in an environment of 23° C., 60% RH. The fixation tailing was evaluated by printing a pattern of lines arranged perpendicularly to the conveying direction of paper, on a paper placed for 24 hours or longer in an environment of 23° C., 60% RH and visually observing the state of fixation tailing. Also the offset phenomenon was evaluated by printing a pattern having characters in a leading portion of 75 mm and a solid white image thereafter, on a paper placed for 24 hours or longer in an environment of 23° C., 60% RH and observing an offset of character pattern onto the solid white portion.

As will be observed in FIG. 6, the fixation tailing was severely observed at a fixing bias voltage of about −200 V, but was improved to a scarcely observable level at a fixing bias voltage of about −800 V.

Also FIG. 7 indicates that the offset phenomenon is alleviated at a larger fixing bias voltage, and a sufficient suppressing effect can be obtained with a fixing bias voltage of about −800 V. In FIGS. 6 and 7, the level of the fixation tailing or the offset phenomenon is represented by taking 5 samples, classifying the level of such phenomenon in 5 ranks from a most inferior rank 1 to a best rank 5, and averaging the ranks of five samples.

Based on the foregoing results, it is identified that the fixation tailing smears and the offset phenomenon can be improved to the acceptable level by setting the fixing bias voltage at about −800 V.

In the following, there will be explained a relationship between the feedback control for the DC high voltage source 101 as the DC charging bias source and the unevenness in the halftone density.

In case of uniformly charging the surface of the photosensitive drum 1 to a potential $V_D$ (dark potential) by the charging roller 2, a DC current flows from the DC high voltage source 101 to the surface of the photosensitive drum 1, and such current varies by a load. For example, in case a portion of the surface of the photosensitive drum 1 where the potential $V_D$ remains without an exposure and a portion where the potential is lowered to $V_L$ (exposure potential) by an exposure with a laser beam are charged again with the charging roller 2 uniformly to the potential $V_D$, the current flowing from the DC high voltage source 101 to the photosensitive drum 1 is different between the portion of $V_D$ and the portion of $V_L$. Consequently a voltage drop by the impedance in the high voltage circuit becomes different, so that the bias voltage supplied as the charging bias becomes different by such voltage drop. Therefore, the surface of the photosensitive drum 1 is not charged uniformly, thus showing a density difference in case of printing a halftone image such as a graphic image. In the present embodiment, therefore, a feedback control is applied so as to obtain a constant bias voltage after the voltage division of the output of the DC high voltage source 101.

Table 1 shows results of comparison of a drum potential difference and a halftone density unevenness in different feedback positions. The drum potential difference was evaluated by printing a solid black image or a solid white image in a first turn of the drum and measuring the potential in a second turn by a surface potential measuring probe opposed to the surface of the photosensitive drum 1. Also the halftone image density unevenness was measured by printing a pattern constituted of a solid white portion for a length of 47 mm from the leading end of the paper (about a half of the peripheral length of photosensitive drum), a solid black portion for a succeeding length of 47 mm and a halftone image thereafter, and visually observing a density difference in the halftone image corresponding to the solid white portion and the solid black portion in the first turn of the drum.

TABLE 1

Relationship between DC charging feedback position and halftone density unevenness

| DC charging feedback position | drum potential difference | halftone density unevenness |
|---|---|---|
| position A (embodiment) | 3 V | + |
| position B (comparative ex.) | 20 V | – |

+: density unevenness absent
–: density unevenness present

As shown in Table 1, in case the feedback is so applied as to obtain a constant output from the DC high voltage source 101 as in the position B, the drum potential after the solid black image formation and that after the solid white image formation show a large difference, resulting in a density unevenness in a halftone image. On the other hand, in case of a feedback control at the position A, the difference between the drum potential after the solid black image formation and that after the solid white image formation becomes small, thus avoiding the density unevenness in the halftone image. Since the safety resistor 106 also aggravates the halftone density unevenness, it was selected relatively small as 27 kΩ in the present embodiment, and it is preferably as small as possible, desirably 100 kΩ or less.

In the present embodiment, the fixing bias voltage was selected as −800 V and the DC charging bias voltage was selected as −600 V, but these voltages are determined by various conditions such as an image forming speed and a configuration of the apparatus, and are not limited to these set values. Also the present embodiment has explained a case where a voltage source is used in common for the fixing bias and the fixing bias, but similar effects can also be obtained in case where a source is used in common for the developing bias.

As explained in the foregoing, by employing a structure of providing a DC high voltage source capable of outputting a bias voltage necessary as a fixing bias, and dividing the output of the DC high voltage source for example by voltage dividing resistors, thereby providing a charging bias and a developing bias or the like, and by effecting a feedback control so as to obtain a desired output voltage after the division of the output of the DC high voltage source, it is rendered possible to obtain a satisfactory image without a fixation tailing and an offset phenomenon, and to prevent a density unevenness for example in a halftone image, resulting from a fluctuation in the charging bias voltage and the developing bias voltage.

This application claims priority from Japanese Patent Application No. 2003-341483 filed Sep. 30, 2003, which is hereby incorporated by reference herein.

What is claimed is:

1. An image forming apparatus for exposing a photosensitive member charged uniformly by a charging apparatus to form an electrostatic latent image, developing said electrostatic latent image with a developing apparatus, transferring the developed image onto a recording material, and heat fixing the image on said recording material by a heat fixing apparatus, the image forming apparatus comprising:

a DC high voltage source serving as a bias source for said heat fixing apparatus;

a voltage divider for dividing an output of said DC high voltage source; and a feedback circuit for feeding a divided output of said voltage divider back to said DC high voltage source thereby executing a feedback control in such a manner that said divided output becomes a desired voltage;

wherein the divided output divided by said voltage divider is used as a bias source for another apparatus in said image forming apparatus.

2. An image forming apparatus according to claim 1, wherein said another apparatus is said charging apparatus.

3. An image forming apparatus according to claim 2, wherein said heat fixing apparatus includes a fixing film.

4. An image forming apparatus according to claim 1, wherein said another apparatus is said developing apparatus.

5. An image forming apparatus according to claim 4, wherein said heat fixing apparatus includes a fixing film.

6. An image forming apparatus according to claim 1, wherein said heat fixing apparatus includes a fixing film.

7. An image forming apparatus for forming, by a gaseous phase discharge, an electrostatic latent image on a dielectric member, developing said electrostatic latent image with a developing apparatus, transferring the developed image onto a recording material, and heat fixing the image on said recording material by a heat fixing apparatus, the image forming apparatus comprising:

a DC high voltage source serving as a bias source for said heat fixing apparatus;

a voltage divider for dividing an output of said DC high voltage source; and a feedback circuit for feeding a divided output of said voltage divider back to said DC high voltage source thereby executing a feedback control in such a manner that said divided output becomes a desired voltage;

wherein the divided output fed by said feedback circuit is used as a bias source for said developing apparatus.

8. An image forming apparatus according to claim 7, wherein said heat fixing apparatus includes a fixing film.

9. An image forming apparatus provided with an exposure apparatus for exposing a photosensitive member charged uniformly by a charging apparatus to form an electrostatic latent image, a developing apparatus for developing said electrostatic latent image, and a heat fixing apparatus for heat fixing an image on a recording material, the image forming apparatus comprising:

a power source apparatus for supplying said charging apparatus with a charging bias and capable of generating a voltage larger than a voltage required for the charging bias;

a voltage divider for dividing an output of said power source apparatus; and a feedback circuit for feeding a divided output of said voltage divider back to said power source apparatus thereby executing a feedback control in such a manner that said divided output becomes a desired voltage;

wherein the divided output divided by said feedback circuit is supplied to the charging apparatus and the output of said power source apparatus is supplied to said heat fixing apparatus.

* * * * *

UNITED STATES PATENT AND TRADEMARK OFFICE

CERTIFICATE OF CORRECTION

PATENT NO. : 7,190,917 B2
APPLICATION NO. : 10/950427
DATED : March 13, 2007
INVENTOR(S) : Masahiko Suzumi et al.

It is certified that error appears in the above-identified patent and that said Letters Patent is hereby corrected as shown below:

COLUMN 1:
Line 43, “then” should read --then is--.
Line 65, “apparatus such” should read --apparatus--.

COLUMN 2:
Line 32, “direction” should read --direction of--.

COLUMN 3:
Line 22, “ejected” should read --ejection--.

COLUMN 4:
Line 27, “value;” should read --value,--.
Line 49, “value;” should read --value,--.
Line 52, “one” should read --one of--.

COLUMN 5:
Line 4, “voltage;” should read --voltage,--.
Line 10, “an.” should read --an--.
Line 27, “smears” should read --smear--.

COLUMN 6:
Line 19, “of” should read --of the--.
Line 49, “or” (second occurrence) should read --of--.

COLUMN 7:
Line 51, “transformere” should read --transformer--.
Line 52, “transformere” should read --transformer--.

UNITED STATES PATENT AND TRADEMARK OFFICE

CERTIFICATE OF CORRECTION

PATENT NO. : 7,190,917 B2
APPLICATION NO. : 10/950427
DATED : March 13, 2007
INVENTOR(S) : Masahiko Suzumi et al.

It is certified that error appears in the above-identified patent and that said Letters Patent is hereby corrected as shown below:

COLUMN 9:
Line 3, "of" should read --of the--.
Line 43, "fixing" should read --charging--.

Signed and Sealed this

Eighth Day of April, 2008

JON W. DUDAS
*Director of the United States Patent and Trademark Office*